US006116212A

United States Patent [19]

Dykstra

[11] Patent Number: 6,116,212

[45] Date of Patent: Sep. 12, 2000

[54] ENGINE SPEED LIMITER

[75] Inventor: Richard A. Dykstra, Cedar Grove, Wis.

[73] Assignee: Briggs & Stratton Corporation, Milwaukee, Wis.

[21] Appl. No.: 09/325,476

[22] Filed: Jun. 3, 1999

[51] Int. Cl.[7] ..... F02P 11/00

[52] U.S. Cl. ..... 123/335

[58] Field of Search ..... 123/149 A, 149 D, 123/198 DC, 335, 630, 651

[56] References Cited

U.S. PATENT DOCUMENTS

| | | | |
|---|---|---|---|
| 3,776,204 | 12/1973 | Harris | 123/335 |
| 3,875,915 | 4/1975 | Anderson et al. | 123/335 |
| 4,074,665 | 2/1978 | Patis | 123/335 |
| 4,144,859 | 3/1979 | Ohki et al. | 123/335 |
| 4,163,431 | 8/1979 | Wilkinson | 123/335 |
| 4,163,437 | 8/1979 | Notaras et al. | 123/149 D X |
| 4,404,940 | 9/1983 | Sieja | 123/335 |
| 4,462,356 | 7/1984 | Hirt | 123/335 |
| 4,648,366 | 3/1987 | Thornton-Trump | 123/335 |
| 4,776,311 | 10/1988 | Venieres et al. | 123/335 |
| 4,911,126 | 3/1990 | Notaras et al. | 123/406.54 |
| 4,977,877 | 12/1990 | Dykstra | 123/335 |
| 5,245,965 | 9/1993 | Andersson | 123/335 |
| 5,755,199 | 5/1998 | Costello et al. | 123/335 |

*Primary Examiner*—Tony M. Argenbright
*Attorney, Agent, or Firm*—Michael Best & Friedrich LLP

[57] ABSTRACT

An engine speed limiter for an internal combustion engine having an ignition primary winding that outputs an ignition pulse and fires a spark plug in response to the ignition pulse is disclosed. An electrical storage device receives electrical energy from the ignition primary winding. A control circuit receives electrical energy from the electrical storage device and generates a trigger signal. The potential of the received electrical energy of the controller is limited to a predetermined value by the controller. A switching mechanism is responsive to the trigger signal and shorts the ignition pulse, thereby preventing the spark plug from firing.

11 Claims, 1 Drawing Sheet

ENGINE SPEED LIMITER

BACKGROUND OF THE INVENTION

The present invention relates to speed limiters for internal combustion engines, and more particularly to speed limiters for small internal combustion engines of the type used to power outboard motors, lawnmowers, snow blowers, generators and the like.

Conventional internal combustion engines comprise a primary and a secondary winding that are inductively coupled with one another. A spark plug is connected across the terminals of the secondary winding, and a switch is used for closing a circuit to enable current to flow in the primary winding and for opening the circuit at a time when the spark plug is to be fired. In battery ignition systems, the closing of the circuit that includes the switch allows battery current to flow in the primary winding. In a magneto-ignition system, an electromagnetic field is induced in the primary winding by an orbitally moving magnet in cooperation with a fixed ferromagnetic core around which the primary and secondary windings are wound. The closing of the switch short circuits the primary winding, thus allowing current to flow in it.

The conventional speed limiter timing circuit typically utilizes a digital timer, such as a 555 timer, that outputs a control signal based on an input signal. Because the timer is digital, the input signal is typically a modified signal that has been conditioned to work with the digital circuitry, but is based on a raw data signal. Thus, because a digital timer may handle a raw data signal directly, it may be necessary to condition or enhance the incoming signal. Such digital circuitry is relatively high in cost and requires more room on a circuit board. The use of a larger circuit board affects packaging of the unit as well, requiring a larger housing that is more bulky.

In the past, conventional control switch typically included a pair of hard metal breaker points that were actuated by a mechanism having a cam that rotated in timed relation to the engine's cycle. Other conventional control means include the use of semiconductor devices such as transistors to control primary winding current in a timed relation with the engine's cycle.

Electronic speed limiters are also known which are an integral part of the engine ignition system. A conventional control switch means includes the use of a silicone controlled rectifier (SCR) of the drive circuit of the ignition system. Such speed limiters have the disadvantage that they cannot be easily retrofitted onto an existing engine's ignition system without replacing at least a portion of the ignition system. Also, such speed limiters cannot be easily added as an option onto a standard production engine ignition system.

SUMMARY OF THE INVENTION

A speed limiter for internal combustion engines is disclosed which is inexpensive, expected to be more reliable, independent of the ignition system and which may be easily retrofit onto or made an option of an existing or standard internal combustion engine. The speed limiter is preferably used with engines having a fixed-timing ignition system and having an ignition primary winding that outputs an ignition pulse. The secondary winding is electrically connected to a spark plug.

The speed limiter includes an electrical storage device for receiving electrical energy from the ignition primary winding. The speed limiter also includes a control circuit that receives electrical energy from the electrical storage device and that generates a trigger signal. The potential of the electrical energy received by the control circuit is limited to a predetermined value. The limiting of the received electrical energy is accomplished by the control circuit. A switching mechanism is responsive to the trigger signal of the control circuit which shorts the ignition pulse, thereby preventing the spark plug from firing.

In a preferred embodiment, the electrical storage device receives electrical energy during the leading half-cycle of the ignition coil's primary winding voltage. Also in a preferred embodiment, the switching mechanism is independent of the ignition system. In the preferred embodiment the switching mechanism limits the ignition coil voltage to a value below that which is necessary to produce a spark plug arc.

It is a feature and an advantage of the present invention to provide a simple and inexpensive engine speed limiter which may be an option or retrofit onto a standard internal combustion engine.

It is another feature and advantage of the present invention to provide electronic speed limiting control using standard analog, off the shelf components.

It is another feature and advantage of the present invention to provide a speed limiting switching mechanism that is substantially independent of the ignition system.

These and other features and advantages of the present invention will be apparent to those skilled in the art from the following detailed description of a preferred embodiment and attached drawings in which:

DETAILED DESCRIPTION OF THE PREFERRED EMBODIMENT

Figure 1:
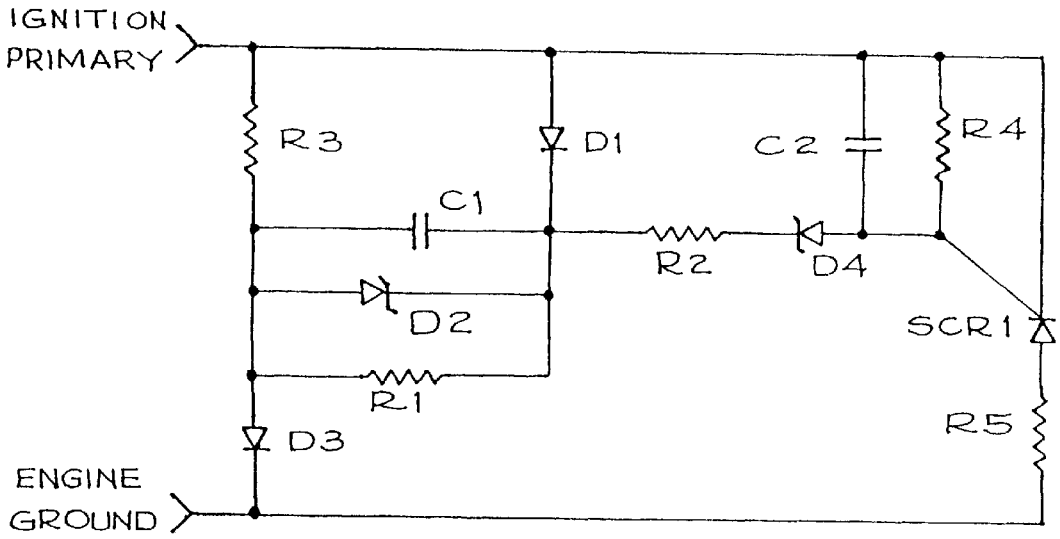
FIG. 1 is a schematic drawing of the preferred embodiment of the present invention.

FIG. 1 is a schematic drawing of the preferred embodiment of the present invention. The speed limiter is designed for an internal combustion engine having a magneto-type ignition system, wherein the engine has an ignition primary winding that outputs an ignition pulse. The magneto ignition system includes a magnet disposed on a rotating flywheel that magnetically interacts with the primary winding.

Figure 2:
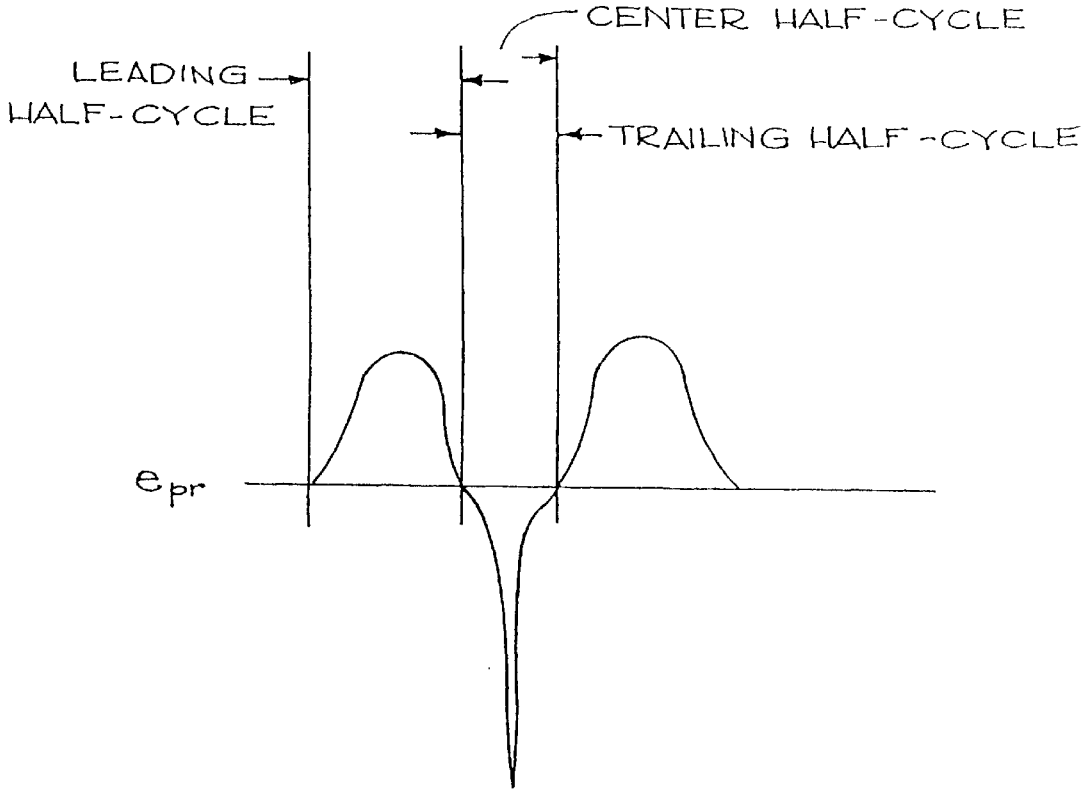
FIG. 2 illustrates an input waveform from the ignition primary winding.

FIG. 2 illustrates an input waveform from the ignition primary winding. As shown in FIG. 2, the ignition pulse is composed of leading and trailing half-cycles of one polarity, with a center half-cycle of an opposite polarity.

Referring to FIG. 1, during the leading half-cycle of the ignition coil's primary winding voltage, an electric storage device or capacitor Cl charges via rectifiers D1 and D3. A limiter D2 limits the capacitor voltage to a predetermined value regardless of the magnitude of the ignition pulse. In a preferred embodiment, the limiter D2 is a zener diode. However, it is contemplated that any device that is capable of limiting a supply voltage to a capacitor could be used.

After the leading half-cycle of the primary winding voltage reaches its peak and falls below the value required to sustain conduction through the capacitor C1 and rectifiers D1 and D3, the capacitor C1 begins to discharge through a resistance means R2, a zener diode D4, the gate to cathode junction of SCR1 and resistance means R3. At low engine speeds, the voltage of capacitor C1 will drop below the value required to actuate SCR1 before the center half-cycle of primary-winding voltage begins. Thus, ignition voltage is provided to the engine's spark plug in a normal manner.

When engine speed reaches a predetermined value, the capacitor C1 continues to discharge through the gate to cathode junction of SCR1 after the center half-cycle of the primary winding voltage begins. The SCR1 thus conducts and shunts the center half-cycle of the ignition coil voltage through an optional current limiting resistor R5. Accordingly, the ignition coil voltage is limited to a value too low to produce a spark plug arc. A capacitor C2 is positioned in parallel to a resistance means R4 and prevents any rapid change of voltage with respect to time from inadvertently switching SCR1 ON. Further, the resistance means R4 allows the capacitor C2 to completely discharge between operating cycles.

In a preferred embodiment, the value of resistor R1 can be set or calibrated, thus making it possible to set or trim the limit speed for each speed limiter module produced in cases in which a higher degree of module to module repeatability is deemed necessary.

Although a preferred embodiment of the present invention has been shown and described, other alternate embodiments will be apparent to those skilled in the art and are within the intended scope of the present invention. Therefore the present invention is to be limited only by the following claims:

I claim:

1. A speed limiter for an internal combustion engine, said engine having an ignition primary winding that outputs an ignition pulse, the ignition pulse having a leading half-cycle, a center half-cycle and a trailing half-cycle, wherein a spark plug fires in response to said ignition pulse, said speed limiter comprising:

an electrical storage device for receiving electrical energy from said ignition primary winding;

a control circuit that receives electrical energy from said electrical storage device and that generates a trigger signal, the potential of the received electrical energy being limited to a predetermined value by said control circuit; and a switching mechanism responsive to said trigger signal to short the ignition pulse, thereby preventing said spark plug from firing.

2. The speed limiter of claim 1 wherein said electrical storage device receives electrical energy during the leading half-cycle of the ignition pulse voltage.

3. The speed limiter of claim 1 further comprising a limiter responsive to said ignition pulse, said limiter limiting the electric storage device voltage to a predetermined value regardless of the magnitude of said ignition pulse.

4. The speed limiter of claim 3, wherein said limiter further comprises a zener diode.

5. The speed limiter of claim 1, further comprising resistance means that can be set to establish the desired limit speed.

6. The speed limiter of claim 5, wherein the resistance means further comprises a variable resistor.

7. The speed limiter of claim 1, wherein the switching mechanism is substantially independent of the ignition system.

8. The speed limiter of claim 1, wherein said switching mechanism further comprises a silicone controlled rectifier.

9. The speed limiter of claim 1, wherein said switching mechanism further comprises a transistor.

10. The speed limiter of claim 1, wherein said control circuit includes a timing circuit.

11. The speed limiter of claim 1, wherein said control circuit outputs an analog signal.

* * * * *